US006632072B2

(12) United States Patent
Lipscomb et al.

(10) Patent No.: US 6,632,072 B2
(45) Date of Patent: Oct. 14, 2003

(54) PNEUMATIC PUMP CONTROL SYSTEM AND METHOD OF MAKING THE SAME INCLUDING A PNEUMATIC PRESSURE ACCUMULATOR TUBE

(76) Inventors: Brian E. Lipscomb, 19208 133 Pl. NE., Woodinville, WA (US) 98072; William Carl Garrison, 30821 229$^{th}$Ave. SE., Black Diamond, WA (US) 98010

( * ) Notice: Subject to any disclaimer, the term of this patent is extended or adjusted under 35 U.S.C. 154(b) by 0 days.

(21) Appl. No.: 09/954,587

(22) Filed: Sep. 14, 2001

(65) Prior Publication Data

US 2002/0076330 A1 Jun. 20, 2002

Related U.S. Application Data

(60) Provisional application No. 60/232,776, filed on Sep. 15, 2000.

(51) Int. Cl.$^{7}$ ..... F09B 49/00

(52) U.S. Cl. ..... 417/36; 417/38; 417/40; 417/53; 417/12

(58) Field of Search ..... 417/36, 38, 40, 417/53, 12

(56) References Cited

U.S. PATENT DOCUMENTS

| | | | | |
|---|---|---|---|---|
| 2,948,661 A | | 8/1960 | ONeill | 195/134 |
| 3,025,962 A | | 3/1962 | Williams | 210/86 |
| 3,130,154 A | | 4/1964 | Heskett | 210/104 |
| 3,563,382 A | | 2/1971 | Regent | 210/124 |
| 3,875,051 A | | 4/1975 | Kovarik | 210/2 |
| 3,957,633 A | | 5/1976 | Gatti et al. | 210/104 |
| 4,230,578 A | | 10/1980 | Culp et al. | 210/86 |
| 4,563,274 A | | 1/1986 | Rothon et al. | 210/101 |
| 4,594,153 A | | 6/1986 | Weis | 210/104 |
| 4,715,966 A | | 12/1987 | Bowman | 210/800 |
| 5,312,594 A | | 5/1994 | Heller et al. | 422/106 |
| 5,319,973 A | | 6/1994 | Crayton et al. | 73/290 |
| 5,672,050 A | * | 9/1997 | Webber et al. | 417/18 |
| 5,859,589 A | | 1/1999 | McGrew, Jr. | 340/614 |
| 5,900,546 A | | 5/1999 | Wilkins | 73/290 |
| 5,963,883 A | | 10/1999 | Cunkehman et al. | 702/47 |
| 6,004,463 A | | 12/1999 | Swett | 210/614 |
| 6,012,020 A | | 1/2000 | Gardell et al. | 752/50 |
| 6,203,282 B1 | * | 3/2001 | Morin | 417/423.3 |

* cited by examiner

*Primary Examiner*—Charles G. Freay
*Assistant Examiner*—Emmanuel Sayoc
(74) *Attorney, Agent, or Firm*—William G Forster

(57) ABSTRACT

A pneumatic pump control system for sequentially switching on and off an electrically operated pump disposed in a waste water liquid storage tank The pneumatic pump control system comprises a pneumatic pressure accumulator that is disposed within the liquid storage tank at a predetermined level. The pneumatic pressure accumulator is a dome-type that defines an interior air chamber for containing air, and a lower opening disposed at an elevation that represents a zero reference level within the tank. The lower opening is in communication with the liquids in the liquid storage tank when the level of liquid is as high as the lower opening. A pressure transducer is operatively connected to the pneumatic pressure accumulator for communication with the interior air chamber to measure the differential air pressure between the air within the interior air chamber and the upper layer of air within the liquid storage tank. A first activation means responds to the output signal of the pressure transducer so that the pump is activated for a period of time to discharge a predetermined quantity of liquid. Following this, a clearing activation means responds by activating the pump for a period of time to discharge a predetermined quantity of liquid to lower the liquid level to a level below the zero reference level so that the air captured within the pneumatic pressure accumulator is recharged.

16 Claims, 7 Drawing Sheets

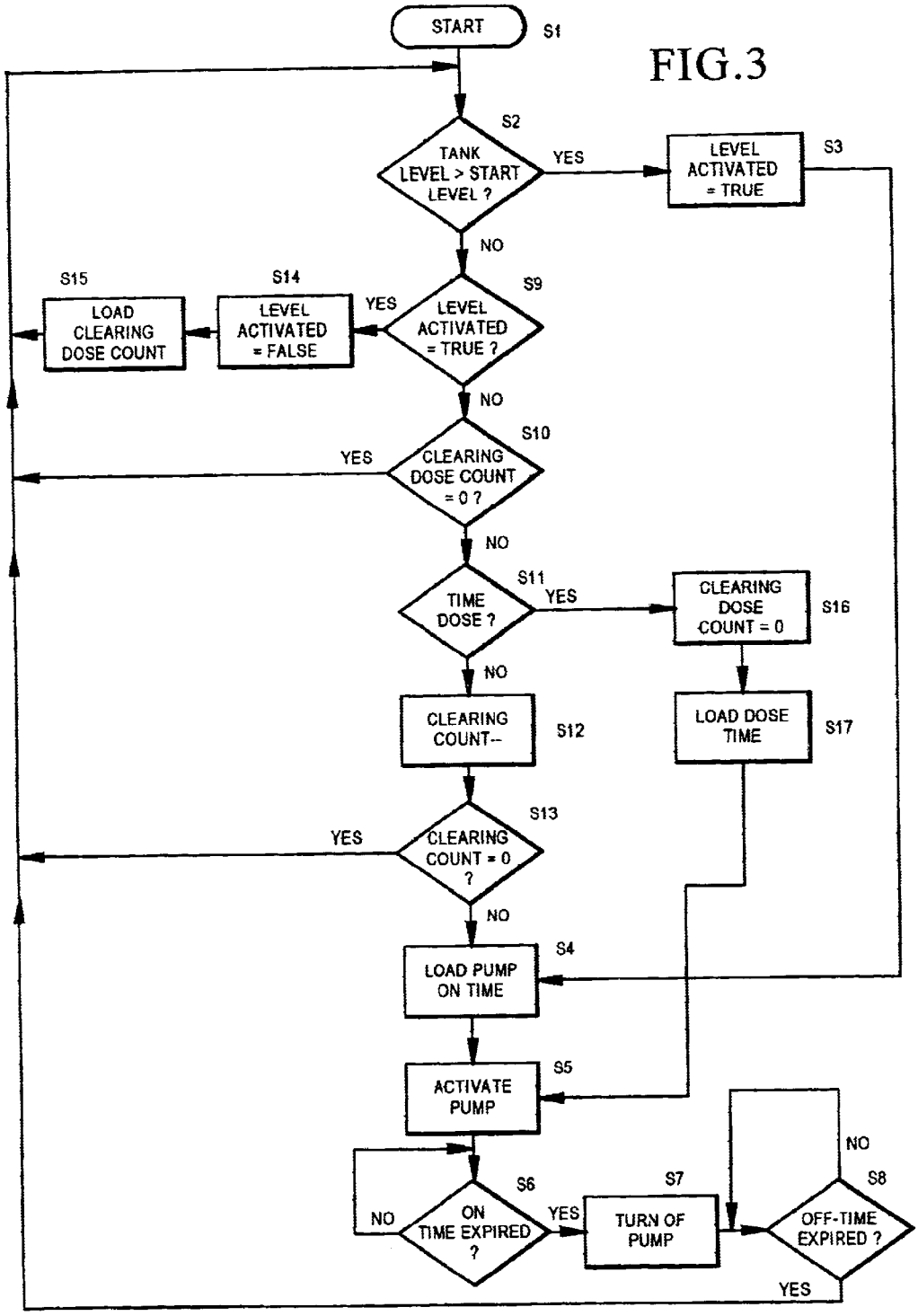
START
S1
FIG.3
S2
TANK LEVEL > START LEVEL ?
YES
LEVEL ACTIVATED = TRUE
S3
NO
S15
S14
S9
LOAD CLEARING DOSE COUNT
LEVEL ACTIVATED = FALSE
YES
LEVEL ACTIVATED = TRUE ?
NO
S10
YES
CLEARING DOSE COUNT = 0 ?
NO
S11
TIME DOSE ?
YES
CLEARING DOSE COUNT = 0
S16
NO
CLEARING COUNT--
S12
LOAD DOSE TIME
S17
S13
YES
CLEARING COUNT = 0 ?
NO
S4
LOAD PUMP ON TIME
S5
ACTIVATE PUMP
NO
S6
S7
S8
NO
ON TIME EXPIRED ?
YES
TURN OF PUMP
OFF-TIME EXPIRED ?
YES

PNEUMATIC PUMP CONTROL SYSTEM AND METHOD OF MAKING THE SAME INCLUDING A PNEUMATIC PRESSURE ACCUMULATOR TUBE

This application claims the benefit of U.S. Provisional Application No. 60/232,776 filed Sep. 15, 2000.

BACKGROUND

This invention relates generally to septic systems that employ discharge pumps for removing waste water from a waste water storage tank or septic tank, and more particularly to the apparatus and method employed for controlling the pump in response to the level of waste water within the septic tank.

More specifically, the invention relates to liquid transfer systems that require timed control of liquid transfer events, such as a septic tank that delivers effluent to a drain field or other destination in controlled quantities or doses. Such transfer systems typically convey a specific volume of liquid, i.e., one or more doses at timed intervals wherein the number of such doses depend upon the liquid level in a storage tank as measured by a liquid level measuring device. In addition, these systems typically initiate and terminate liquid transfer events when the liquid in the storage tank reaches a predetermined level. Typically, liquid transfer systems used in septic tank applications have been controlled using float switches and mechanical timers. Similarly, pressure switches, ultrasonic sensors, and other devices have been used to measure liquid levels in these types of liquid storage tanks. However, these methods are typically either excessively expensive and/or only provide transfer cycle initiation and termination control at specific liquid levels. Moreover, the liquid level sensing ability of low cost pressure transducers is typically inaccurate due to changes in atmospheric pressure, temperature, humidity, and absorption of air into the liquid layer within or below the pneumatic pressure accumulator.

Accordingly, devices for detecting and controlling the level of liquids in liquid storage tanks are well known and used extensively for controlling the quantity of liquid in waste water storage tanks that employ pumps to remove liquid therefrom. For example U.S. Pat. No. 2,948,661 issued in 1960 disclosing a system that employs two differential pressure transmitters for measuring differential air pressure wherein the complexity of a second pressure transmitter is required due to varying liquid levels. In 1962 U.S. Pat. No. 3,025,924 issued disclosing a light sensitive selenium cell for controlling the liquid level in a liquid storage tank. The accuracy of this device, however, depends to a certain extent on the quality of liquid that is being measured.

In 1964 U.S. Pat. No. 3,130,154 issued disclosing a timer clock that controls the closing of a solenoid valve that opens responsive to suction pressure for controlling the liquid level in a tank. Accordingly, its accuracy is dependent upon the quality of supplied suction air.

In contrast, float devices are commonly employed to measure liquid levels and control pumps in tanks. Examples include U.S. Pat. Nos. 3,563,382 and 3,875,051 issued respectively disclosing a float device provided to control the on/off function of a pump in a sewage tank. Likewise, U.S. Pat. Nos. 3,875,051 issued in 1975, 4,230,578 issued in 1980, 4,563,274 issued in 1986, and 5,859,589 along with 5,900,546 issued in 1999, wherein each employ at least one float assembly or float switch to control liquid levels. Importantly, one problem with float-type switches is that it is common for the switch itself to be immersed in the liquid thereby subjecting the switch to corrosion and to solid matter that may be in the tank.

Other liquid level measuring devices include U.S. Pat. No. 3,957,633 disclosing a sensor comprising either a photometric or electrolytic operated device to detect liquid levels; and U.S. Pat. Nos. 4,715,966 and 5,319,973 which employ an ultrasonic device to detect and control liquid levels. The functioning of these devices, however can be effected by the quality of the liquid being measured or sensed.

Finally, pressure transducers are also employed for liquid level detection and control as disclosed in U.S. Pat. Nos. 4,594,153 which employs a pressure transducer that is in continuous communication with a suction conduit to detect liquid levels; 5,312,594 which employs a level controlling device that requires two pressure transducers in its operation; 5,319,973 which employs a ultrasonic transducer that emits ultrasonic pulses toward a float device to control the level of liquid in a tank; 5,963,883 which employs a pair of differential pressure transducers to measure liquid levels; and U.S. Pat. No. 6,004,463 which comprises a pressure transducer means to sense air pressure. Importantly, one problem with pressure transducers, is that the quality of air or liquid that a pressure transducer is in communication with will often change over extended periods of time.

While most of the above noted level detection devices will respond to liquid levels to control pumps in liquid storage tanks, most are in one way or another inaccurate to begin with, or become inaccurate over time, and in addition are complex or expensive to maintain.

Accordingly, a need remains for an accurate, reliable, inexpensive, and simple device or system to monitor and control the level of liquids in waste water tanks in a way where accuracy is maintained over long periods of time with little or no maintenance being required.

SUMMARY

One object of the invention is to accurately control the liquid level in a waste water septic tank.

A second object is to accurately control the amount of liquid dispersed into a septic drain field at predetermined intervals.

Another object is to precisely control the on/off switching of an electrically operated pump in a pneumatic pump control system for sequentially switching on and off an electrically operated pump.

Yet another object is to control the quality of air disposed for communicating changes in pressure thereof responsive to varying liquid levels within a waste water septic tank.

A further object is to precisely monitor and control the pumping activity of an electrically operated pump disposed within a waste water septic tank for pumping waste water into a drain field.

Still another object is to economically control the pumping of waste water from a waste water septic tank.

An additional object is to prevent the degeneration of accuracy of a liquid level measuring device used to control a pump, when the level measuring device is employed over extended periods of time without requiring maintenance.

The invention is a pneumatic pump control system for sequentially switching on and off an electrically operated pump disposed in a liquid storage tank for waste water typically referred to as a septic tank. Typically such tanks are provided for receiving liquids and or a combination of liquids and solids disposed below an upper layer of air. In general, the pneumatic pump control system comprises a pneumatic pressure accumulator that is disposed within the liquid storage tank at a predetermined level. The pneumatic pressure accumulator is a dome-type that defines an interior air chamber for containing air, and a lower opening disposed at an elevation that represents a zero reference level within the tank. Importantly, the lower opening is in communication with the liquids in the liquid storage tank when the level of liquid is as high as the lower opening.

In addition, a pressure transducer is operatively connected to the pneumatic pressure accumulator for communication with the interior air chamber to measure the differential air pressure between the air within the interior air chamber and the upper layer of air within the liquid storage tank. Specifically, the pressure transducer is adapted to generate an electric output signal that varies according to and corresponding to the changing differential air pressure that fluctuates as the liquid level changes.

In this way, a first activation means can respond to the output signal of the pressure transducer such that when the pressure transducer indicates a pressure that corresponds to a liquid level that has risen above a predetermined start-level elevation, within the liquid storage tank, the pump is activated for a period of time to discharge a predetermined quantity of liquid. This predetermined quantity of liquid is referred to as a normal dose. Importantly, one or more normal doses are executed (cycled) to lower the liquid level to a level at or below the start-level.

Following this, as noted above, the pressure transducer indicates a pressure that corresponds to a liquid level that is at or below the start level elevation, wherein a clearing activation means responds by activating the pump for a period of time to discharge a predetermined quantity of liquid that is referred to as a clearing dose. As will be explained in more detail in the description of the preferred embodiment, one or more clearing doses are executed to lower the liquid level to a level below the zero reference level so that the air captured within the pneumatic pressure accumulator is recharged to be of the same consistency as the upper air layer which is the ambient air entrapped within the liquid storage tank.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 3 is a flow chart illustrating steps executed by software embedded in the processor disposed on the pump controller board, wherein the steps illustrate the process flow decisions programmed to periodically clear captured air from the pneumatic accumulator.

FIG. 5 CONT. is the right portion of an electrical schematic diagram illustrating circuitry of the pump controller board and the components thereof.

DETAILED DESCRIPTION OF PREFERRED EMBODIMENT

Figure 1:
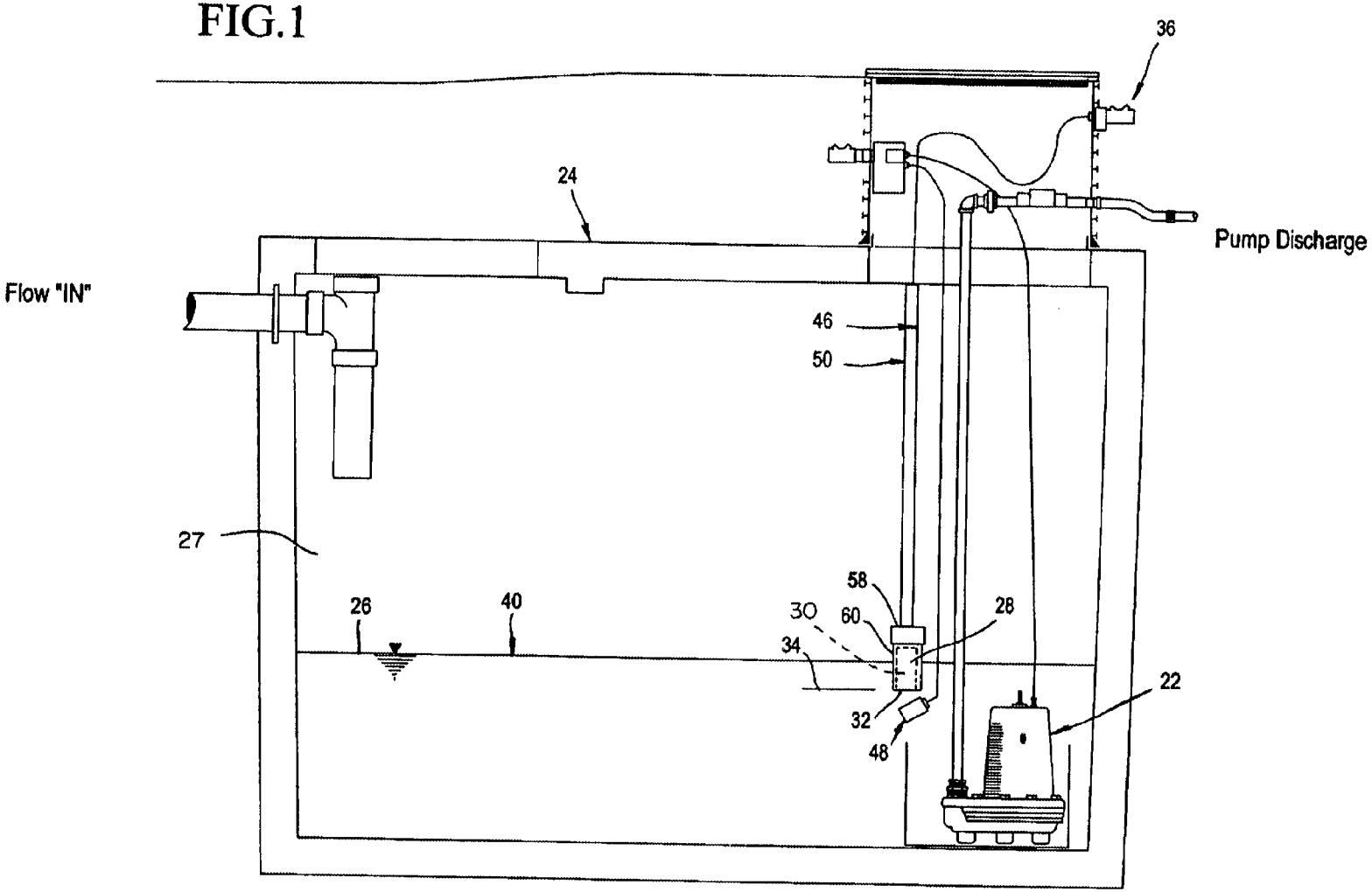
FIG. 1 is a side elevational view of a septic storage tank having portions removed to illustrate the components of a pneumatic pump control system disposed within and adjacent to the septic storage tank including the pneumatic pressure accumulator and its attachment to a pressure transducer disposed out of the septic tank via vinyl tubing.

Referring now to the drawings, and first to FIGS. 1 through 4, shown generally at 20 is a pneumatic pump control system constructed in accordance with the present invention. The pneumatic pump control system 20 is provided for sequentially switching on and off an electrically operated pump 22 disposed in a liquid storage tank 24 for waste water commonly referred to as a septic tank. Typically such tanks are provided for receiving liquids 26 and or a combination of liquids and solids (not illustrated) disposed below an upper layer of air 27. In general, the pump control system 20 comprises a pneumatic pressure accumulator 28 that is disposed within the liquid storage tank 24 at a predetermined level. The pneumatic pressure accumulator 28 is a dome-type that defines an interior air chamber 30 for containing air, and a lower opening 32 disposed at an elevation that represents a zero reference level 34 within the liquid storage tank 24. Importantly, the lower opening 32 is in communication with the liquid 26 in the liquid storage tank 24 when the level of liquid is as high as the lower opening 32. It should be noted that the pneumatic pressure accumulator 28 is "air tight" except for the lower opening 32, i.e., entrapped air can only escape through the lower opening 32.

In addition, a pressure transducer 36 is operatively connected to the pneumatic pressure accumulator 28 for communication therewith to measure the differential air pressure between the air within the interior air chamber 30 and the upper layer of air 27 within the liquid storage tank 24. Specifically, the pressure transducer 36 is adapted to generate an electric output signal that varies according to and corresponding to the changing differential air pressure that fluctuates as the liquid level changes.

In this way, a first activation means can respond to the output signal of the pressure transducer 36 such that when the pressure transducer 36 indicates a pressure that corresponds to a liquid level that has risen above a predetermined start-level elevation 40, within the liquid storage tank 24, the pump 22 is activated for a period of time to discharge a predetermined quantity of liquid 26. This predetermined quantity of liquid 26 is referred to as a normal dose. Importantly, one or more normal doses are executed (cycled) to lower the liquid level to a level below the start-level elevation 40.

Following this, as noted above, the pressure transducer 36 indicates/signals a pressure that corresponds to a liquid level that is at or below the start level elevation 40, wherein this initiates a clearing activation means which responds by activating the pump 22 for a period of time to discharge a predetermined quantity of liquid that is referred to as a clearing dose. As will be explained in more detail in the following, one or more clearing doses are executed to lower the liquid level to a level below the zero reference level 34 so that the air captured within the pneumatic pressure accumulator 28 is recharged so that it will be of the same consistency as the ambient air or upper layer of air 27 entrapped within the liquid storage tank 24.

Importantly, it should be noted that the first activation means and the clearing activation means could take on a many various forms. For example, in its simplest form, the first activation means and clearing activation means could be represented by a user employing a differential pressure measuring instrument (not illustrated) to read differential pressures between the upper layer of air 27 and the internal air chamber 30 of the pneumatic pressure accumulator 28. In this way, the user could calibrate the differential pressure measuring instrument to indicate specific liquid levels so that the user would know when to manually switch on the pump 22 to lower the liquid level when it reaches a start-Level elevation 40, and manually switch off the pump when the liquid level reaches the zero reference level 34 (this would represent a first activation means). Similarly, a user could switch on the pump 22 for a known quantity of time to lower the liquid level to a point well below the zero reference level 34, and then switch the pump 22 off at the end of the set period of time: (this would represent a clearing activation means) where the interior air chamber 30 would be in communication with the upper layer of air 27 thereby clearing all liquid 26 from the pneumatic pressure accumulator 28.

Further, the first activation means and the clearing activation means could be somewhat more complex: it could comprise a pressure transducer 36 employed to generate electric output signals, according to the differential pressures, to be received by a relay-type device (not illustrated) for controlling the switching action of the pump 22 as noted above. Or, as described more fully below in a preferred embodiment, the first activation means and the clearing activation means could comprise a pressure transducer 36 that generates electric output signals that are received by a integrated circuit processor, i.e. controller 44, that reads the signals and responds by taking the appropriate action and recording the same for future reference.

Explaining now in more detail, the relationship between the components of the present invention, attention is directed to FIG. 3 which is a flow chart illustrating the process flow to keep the level of liquid 26 below a start-level elevation 40, and to periodically clear captured air from the interior air chamber 30 of the pneumatic pressure accumulator 28. Importantly, it should be understood that the primary reason for periodically clearing captured air from the pneumatic pressure accumulator 28 is so that its accuracy is continuously maintained. This can only be accomplished by changing the air periodically or by periodically adding more air and letting the excess escape out the lower opening 32.

Specifically, if the level of liquid 26 was not periodically brought to a level below the lower opening 32 of the pneumatic pressure accumulator 28, the liquid level therein would rise due to several factors including, for example, absorption of air into the liquid 26, leakage of air from the seals of the pressure transducer 36, and/or accumulation of solids that could be trapped within. Each of these conditions would cause a change in the internal pressure of the pneumatic pressure accumulator 28 thereby causing the pressure transducer 36 to send false readings to the controller 44 which is provided for reasons which will be explained in more detail below.

Although the present invention solves this problem by lowering the level of liquid 26 below the lower opening 32, other methods exist to achieve the same result. For example, an air bubbler (not illustrated) could be employed to direct air bubbles up and into the interior air chamber 30 thereby expelling absorbed water. Alternately, air could be injected into the interior air chamber 30 periodically to achieve the same result. Each of these alternatives, however, would add significantly to the cost and complexity of the system and therefore are not practical.

In the present invention, the pump 22 is controlled by a controller 44, which is constructed according to specification and its integrated circuit processor U1 (FIG. 5) is programmed, in part, by a Palm® PDA as discussed below. However, as will be more fully discussed below, there are many different types of controllers readily available which can be programmed with programs specific to the particular controller to perform the same function as the controller 44 that is provided in the present invention. Alternately, varying types of controllers could be specially designed and programmed to perform according to the specific needs of a particular septic designer. Accordingly, a person skilled in the art would be familiar with the type and availability of suitable controllers and their operation.

Figure 5:
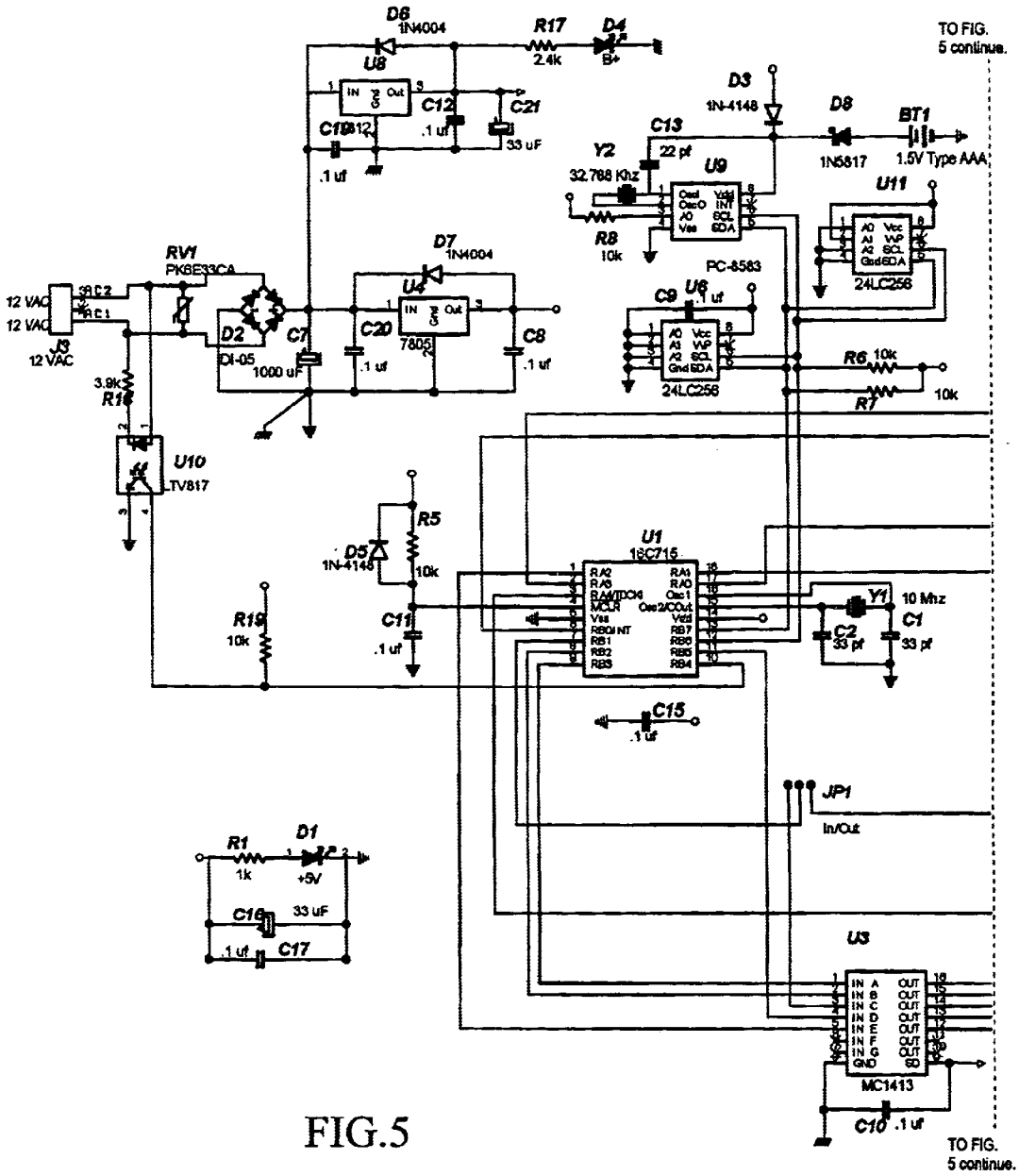
FIG. 5 is the left portion of an electrical schematic diagram illustrating circuitry of the pump controller board and the components thereof.
Figure 5:
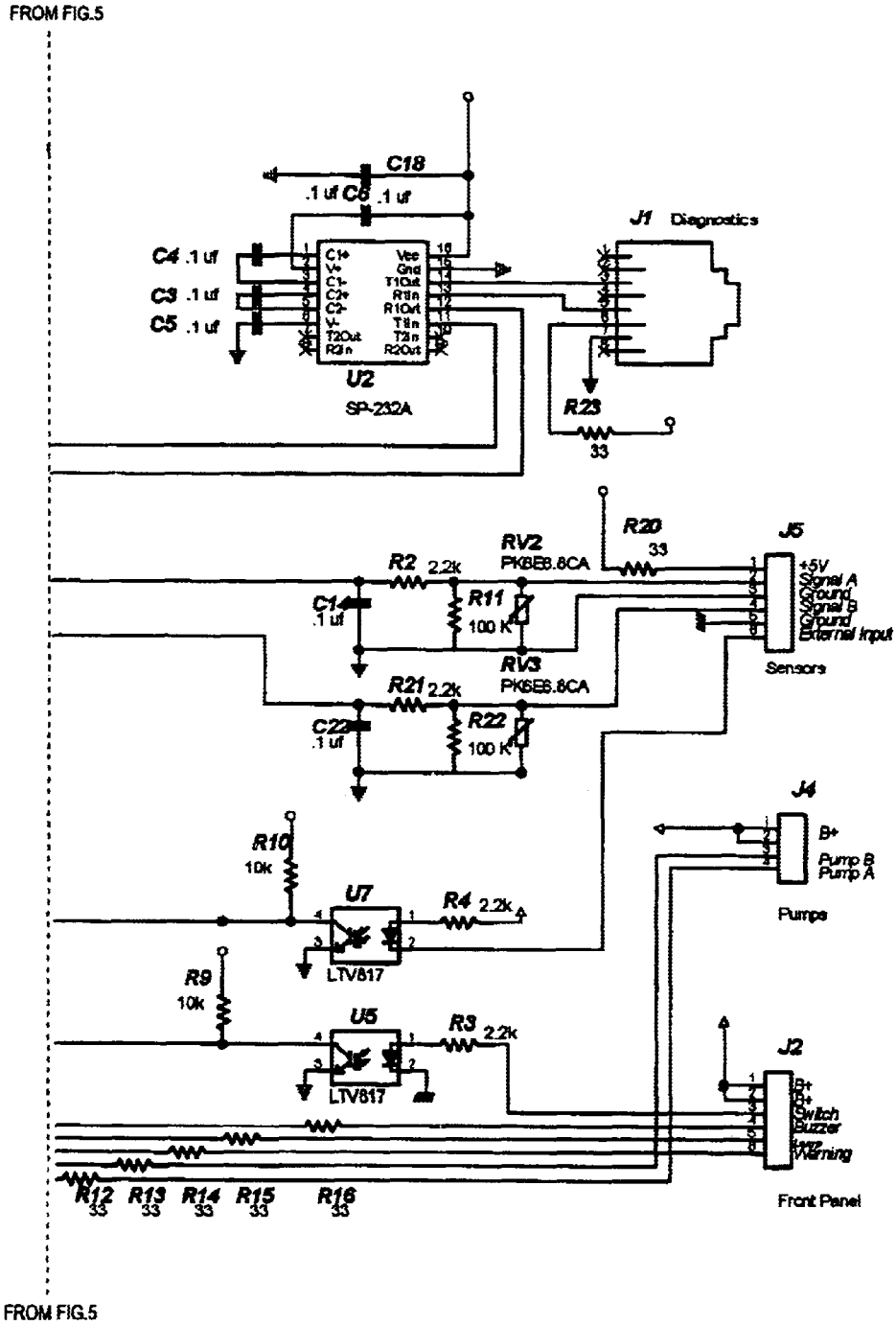

The controller 44 is, in general terms, a circuit board constructed according to the electrical schematic diagram illustrated in FIG. 5 and FIG. 5 CONT. The controller 44 includes a processor designated as U1 that is programmed according to the flow chart denoted in FIG. 3, which diagrams the following steps. Step S1 "start" represents the step of bringing the system on line so that the controller 44 is energized and ready to execute steps 2 through 17. In step S2, the controller 44 checks the liquid level within the liquid storage tank 24 against the Start Level elevation 40. If the liquid level is above the start level elevation 40, the controller proceeds to step S3 where the controller sets a FLAG: (Level Activated=True) which remains unchanged until the level of the liquid storage tank 24 is lowered below the start level elevation 40. This represents the first activation means.

It should be noted that the start level elevation 40 is typically set approximately 1 to 2 inches above the bottom of the pneumatic pressure accumulator 28, i.e., at the lower opening 32 which is equal to the zero reference level 34. In addition, it should be understood that this is a setting which can be changed or adjusted by the designer of the septic system according to the optimal settings which are dictated by a the size of tank that works in combination with a specific size of drain field.

Next, the controller executes step S4 where the "load Pump On Time" is loaded into the program memory so that the controller 44 can then execute step S5 "Activate Pump" for a specific period of time. Step S6 "On-Time Expired?" keeps track of the programmed time "on" for the pump 22 wherein when the time expires the controller 44 then moves to step S7 "Turn Off Pump". Similarly, the time for cycling the pump 22 off is controlled by step S8 "Off-Time Expired?" wherein the controller stays in that loop until the off time has expired wherein the controller 44 moves to the beginning step S2 to start the entire sequence again for as many times as is required to bring the level of liquid 26 to an elevation that is at or below the Start Level elevation 40. Importantly, it should be understood that the above noted sequence represents the first activation means steps, S3 through S2, wherein step S4 through S8 represents the on cycle to produce a normal dose.

After the above sequence has lowered the level of liquid 26 to a level below the start level elevation 40, the controller moves from step S2 to Step S9 where "Level Activated= True," is affirmative thereby causing the controller 44 to move to step S14 where the internal flag is changed to "Level Activated=False" which is followed by step S15 "Load Clearing Dose Count". Here, the controller is directed to load into memory the number of clearing dose counts, i.e., the number of clearing doses that should be executed.

From there the controller 44 moves to step S2 where (tank level is not below the start level) is indicated. Accordingly, the controller moves to step S3 where the internal flag has been set to "Level Activated=False" thereby causing the controller 44 to move to step S0 "Time Dose?". Here, the controller 44 is typically programmed to answer "no" because only one or more normal doses are required, i.e., steps S4 through S8 equal a normal dose and similarly a clearing dose. Thus the controller moves to step S12 where the clearing dose count is reduced by 1, i.e., −1. The controller 44 then moves to step S13 to test whether there is at least one clearing dose count remaining. Typically the initial dose count is set to a number where at lease one clearing dose is executed so that steps S4 through S10 are executed, and where the controller completes the loop to again test the clearing dose count. If only one clearing dose is required, 1 dose count remains which causes the controller 44 to move to step S12 to execute a minus 1 to leave the remaining dose count at 0. This in turn causes the controller to proceed back to step S10 where the controller remains in loop S10 to S2 to S9 and then back to S10. The controller then remains in this loop until the level of liquid 26 rises above the start level elevation 40 where the controller would then be directed to step S3 to start the whole process again.

Importantly, it should be understood that the above noted sequence represents the clearing activation means, i.e., steps S2 through S8, wherein steps S4 through S8 represents the on cycle to produce a clearing dose. Typically, most systems only require one clearing dose which brings the level of liquid 26 down 1 to 3 inches: from just below the start-level elevation 40, to below the zero reference level 34 thereby clearing the pneumatic pressure accumulator 28, recharging the same so that the air within accumulator is of the same consistency as the ambient air entrapped within the liquid storage tank 24.

In addition, it was noted above that the controller 44 is generally programmed to move from step S11 "Time Dose?" to step S12 thereby executing one or more clearing doses as opposed to executing a timed dose. However, if the system designer so desires, a timed dose can be executed by programming the controller 44 to move from S11 to step S16 "clearing count=0" and then to step S17 where the programmed time for the clearing dose is entered prior to executing the same in step S4 "load pump on Time". From there, the controller 44 executes steps S5 through S10 where loop S10 through S9 is continually repeated until the level of liquid 26 rises above the start-level elevation 40.

Importantly, it should be noted that the system designer actively controls, i.e., programs all settings that control the operation of the pump 22 which includes, but is not limited to, the on-time when the pump 22 is cycled on; the off-time when the pump 22 is cycled off; and number of doses, i.e. dose counts for the both the normal doses and the clearing doses. Further, these calculations and/or settings are well known to designers skilled in the art wherein the extent of variations are beyond the scope of this disclosure. Likewise, the skilled designer can program other events including the status and record of all events including duration of pump run times and dates; power up, power down; log flags; specific pump settings for specific liquid levels; alarm settings; and many other features that are, as noted above, beyond the scope of this disclosure. Further, with the likes of wireless technology presently available, the controller 44 can be configured and equipped to receive remote commands for programming the same, and likewise, the controller 44 can be equipped to transmit information, as noted above to remote locations. Accordingly, this feature could be particularly useful for a system designer to carefully monitor a system that is experiencing malfunctions of some sort wherein the designer is not required to be on site for the monitoring operation. It should be noted that, like the controller 44, numerous configurations are possible regarding the equipment employed for transmitting and receiving wireless signals.

Figure 4:
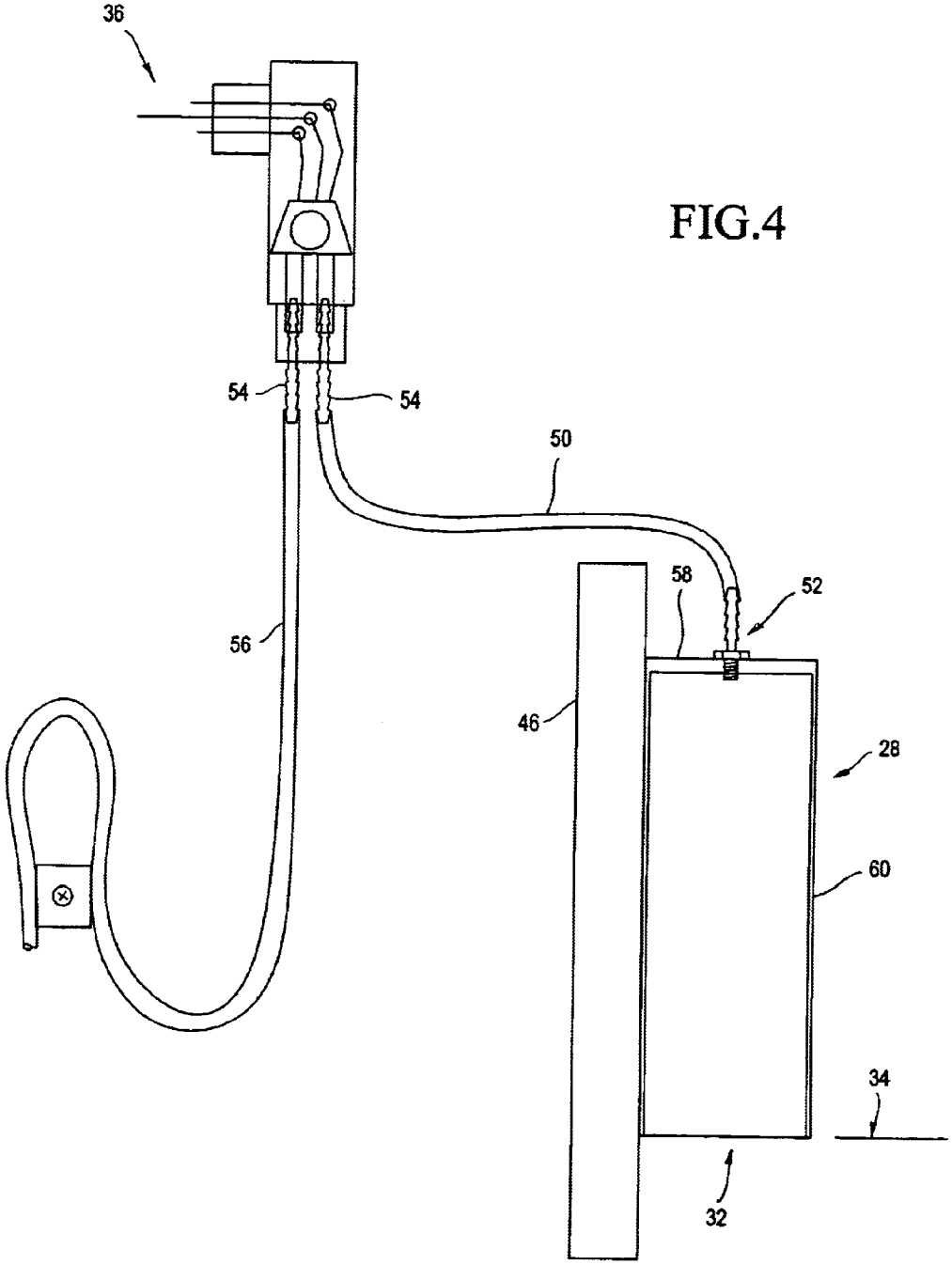
FIG. 4 is a enlarged schematic diagram illustrating the pneumatic connections between a pressure transducer and a pneumatic pressure accumulator as well as electrical connections from the pressure transducer.

Turning now to FIGS. 1 and 4, the components of a pneumatic pump control system 20 disposed within or adjacent to the liquid storage tank 24 are illustrated. Included therein is a pneumatic pressure accumulator 28 that is attached to a float tree 46. Typically a float tree 46 is provided to support a standard float 48. However, because the present invention replaces such floats, they are so provided only when state law requires the same. Indeed, such floats are generally viewed as being undesirable because wiring must be routed into the tank, down to the float 46. Accordingly, it is possible for the float switch (not illustrated) to create a spark which, under some circumstances, could cause an explosion. The present invention eliminates this possibility because no wiring for the same is disposed within the liquid storage tank 24.

As can be seen, the pressure transducer 36 can be disposed above the float 46 such that the lower opening 32 is approximately 2 inches above the same, and approximately 4 inches above the top of the pump 22. In this way, the float 48 is employed only as a precautionary measure.

Importantly, the pneumatic pressure accumulator 28 is connected to the pressure transducer 36 via flexible tubing 50. For this purpose an air tight nipple 52 is provided out the top of the pneumatic pressure accumulator 28. Similarly, a barbed nipple 54 is provided out of the pressure transducer 36. Typically, the flexible tubing 50 is routed along the float tree 46 from the pneumatic pressure accumulator 28 to the pressure transducer 36 which is fixed to the outside of the liquid storage tank 24. Additionally, the pressure transducer 36 includes a like barbed nipple 54 so that a snorkel tube 56 can connect the pressure transducer 36 with the ambient air within the liquid storage tank 24. Regarding the pneumatic pressure accumulator 28, it should be noted that the construction thereof is very simple and straight forward. Specifically, pneumatic pressure accumulator 28 is a short section of plastic pipe 60 with a cap 58 welded to one end, wherein a hole is provided through the cap 58 for the barbed nipple 52. In addition, the pressure transducer 36 is a standard readily available part having a three wire connection that leads to the controller 44 some distance from the liquid storage tank 24.

Figure 2:
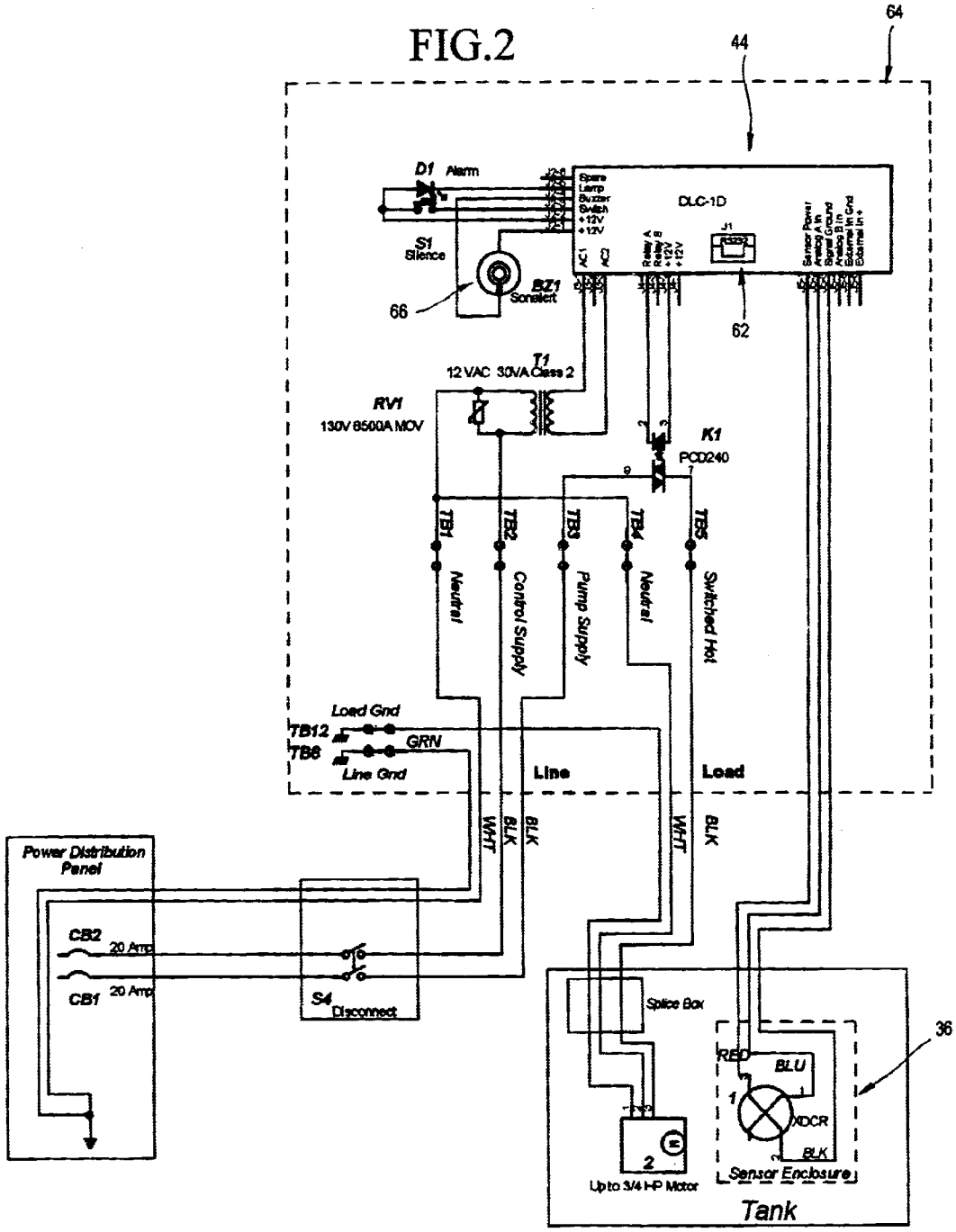
FIG. 2 is a electrical schematic diagram illustrating the pump controller and the electrical connections of the primary components thereto including the solid state relays, pressure transducer, and PDA or computer connection.

Directing attention to FIG. 2, an electrical schematic diagram is provided illustrating the pump controller 44 and the electrical connections of the primary components thereto including the solid state relays, pressure transducer 36, and PDA or computer connection port 62. The wiring between the components is basic and provides to an installer the specific information required for field installation of the enclosure 64 in which the controller 44 and required electrical components including an alert switch 66 are housed.

In more specific terms, Table I below sets forth a parts list for the various electrical components that comprise the controller 44. Such components should be viewed as circuit board components. The part numbers in Table I correspond to like part numbers in FIG. 5 and FIG. 5 CONT which is a schematic of the electrical circuitry. In addition, Table II below sets forth a parts list for the various other electrical components that are required outside of the controller 44.

The skilled person, having the benefit of the information listed on Tables I and II, along with the electrical schematics shown in FIGS. 5 FIG. 5 CONT and FIG. 2 could easily ascertain how the invention works, and could easily build it in the form depicted in FIGS. 5 and 2, or otherwise adapt the circuitry to cooperate with other forms of programming device(s) (not illustrated).

TABLE I

PUMP CONTROLLER CIRCUIT BOARD BILL OF MATERIALS

| Quantity | Reference | Part | Description | MFG |
|---|---|---|---|---|
| 2 | R11, R22 | 100K | RES | GENERIC |
| 7 | R5–10, R19 | 10K | RES | GENERIC |
| 1 | R1 | 1K | RES | GENERIC |
| 4 | R2–4, R21 | 2.2K | RES | GENERIC |
| 1 | R17 | 2.4K | RES | GENERIC |
| 1 | R18 | 3.9K | RES | GENERIC |
| 7 | R12–16, R20, R23 | 33 OHMS | RES | GENERIC |
| 15 | C3–6, C8–12, C14–15, C17–20, C22 | .1 uF | CAP | GENERIC |
| 2 | C1–2 | 33 pf | CAP | GENERIC |
| 1 | C13 | 22 pf | CAP | GENERIC |
| 2 | C16, C21 | 33 uf | CAP | GENERIC |
| 2 | D3, D5 | IN4148 | DIODE | GENERIC |
| 2 | D6 D7 | IN4004 | DIODE | GENERIC |
| 1 | D8 | IN5817 | DIODE | GENERIC |
| 1 | D4 | B + LED | DIODE/ RECTIFIER | GENERIC |
| 1 | D1 | +5 V LED | DIODE/ RECTIFIER | GENERIC |
| 1 | D2 | DI-05 | DIODE | GENERIC |
| 1 | RV1 | PR6E33CA | VARISTOR | GENERIC |
| 2 | RV2–3 | PK6E6.8CA | DIODE | GENERIC |
| 1 | U1 | 16C715 | IC | MICROCHIP |
| 2 | U6 U11 | 24LC256 | IC | AMP |
| 3 | U5 U7 U10 | LTV817 | IC | LITEON |
| 1 | U2 | SP-232A | IC | SIPEX |
| 1 | U9 | PC-8583 | CLOCK/ CALENDER | PHILLIPS |
| 1 | U3 | MC1413 | IC | MOTOROLA |
| 3 | U5 U7 U10 | LTV817 | IC HI DENSITY, PHOTO | LITEON |
| 1 | U4 | MC78M05B | REGULATOR | MOTOROLA |
| 1 | U8 | MC78M12B | REGULATOR | MOTOROLA |
| 1 | BT1 | 1.5 V | BATT CLIP | GENERIC |
| 1 | Y1 | 10 Mhg | CRYSTAL | GENERIC |
| 1 | Y2 | 32.768 Khg | CRYSTAL | GENERIC |
| 1 | C7 | 1000 uF | CAP | GENERIC |
| 1 | J3 | 12V 3 PIN | SOCKET | GENERIC |
| 1 | J1 | 8 PIN MODULAR | SOCKET | GENERIC |
| 1 | J2 | 6 PIN HEADER | | GENERIC |
| 1 | JP1 | IN/OUT | | GENERIC |
| 1 | J4 | PUMPS 4 PIN | | GENERIC |
| 1 | J5 | SENSORS 6 Pos SCREW | | GENERIC |

TABLE II

MISCELLANEOUS COMPONENTS BILL OF MATERIALS

| Quantity | Reference | Part | Description | MFG |
|---|---|---|---|---|
| 5 | TB1 TB2 TB3 TB4 TB5 TB6 TB7 | | TERIMINAL BLOCK | GENERIC |
| 2 | TI | 12 VAC 30 VA | TRANSFORMER | GENERIC |

TABLE II-continued

MISCELLANEOUS COMPONENTS BILL OF MATERIALS

| Quantity | Reference | Part | Description | MFG |
|---|---|---|---|---|
| 1 | RV1 | | 130 V 6500A MOV | GENERIC |
| 1 | KI | PCD24O | RELAY | GENERIC |
| 1 | S1 | SWITCH | SILENCE PB ASSY | GENERIC |
| 1 | D1 | | ALARM PB ASSY | GENERIC |
| 1 | BZ1 | | SONALERT | GENERIC |
| 1 | XDCR | MPX5010DP | TRANSDUCER | MOTOROLA |
| 2 | TB12 TB 6 | | TERMINAL BLOCK | GENERIC |
| 2 | CB1 CB2 | | CIRCUIT BREAKER | GENERIC |
| 1 | S2 | | DISCONNECT | GENERIC |

Figure 6:
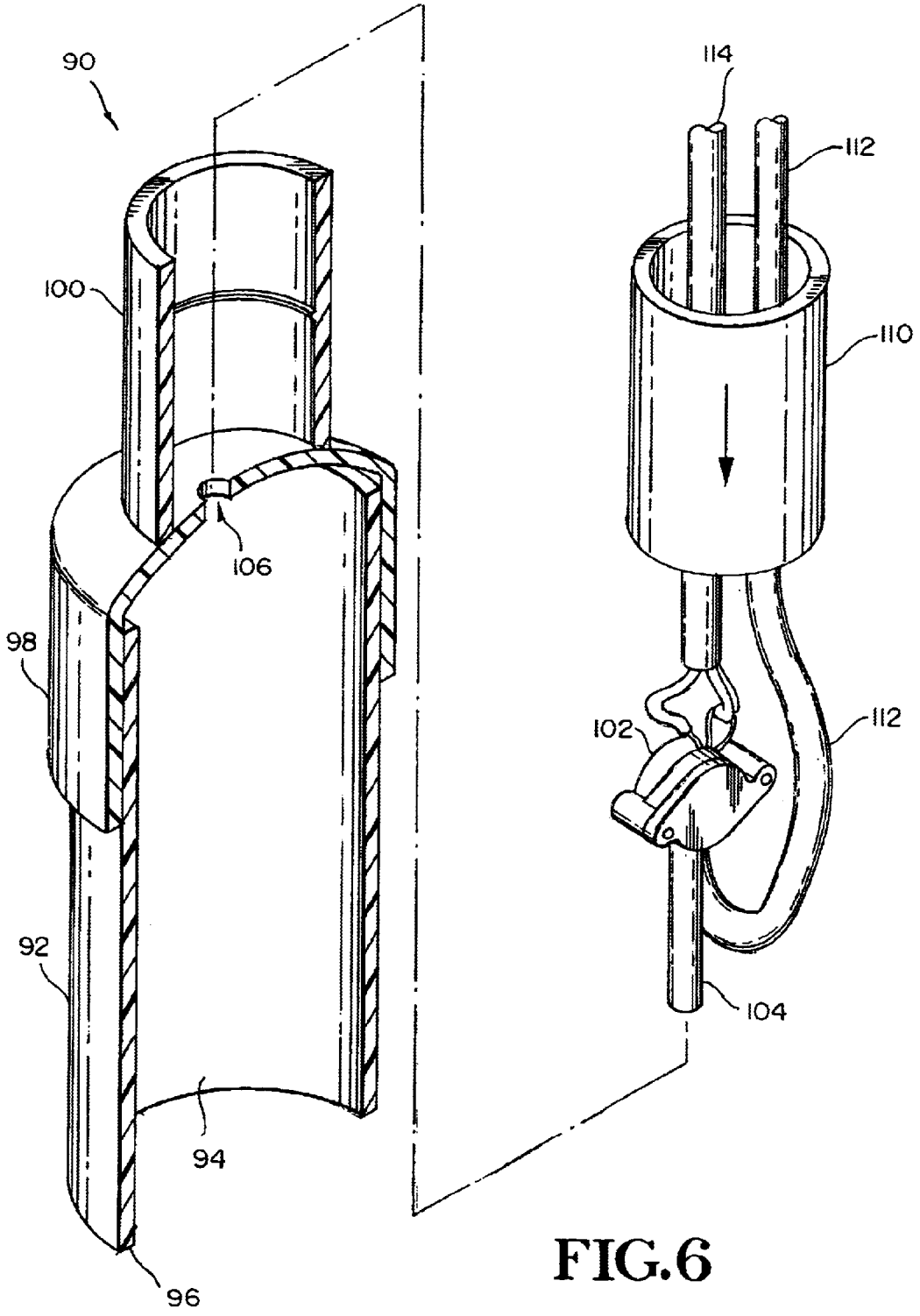
FIG. 6 is an exploded view of an alternate embodiment pneumatic pressure accumulator with a transducer being integrally disposed therein, and with portions of the accumulator dome being cut-away to illustrate the components thereof.

Turning now to FIG. 6, an alternate embodiment pneumatic pressure accumulator 90 is illustrated. This embodiment is provided to simplify the installation and maintenance of the system. Included therein is an accumulator dome 92 which is formed out of common PVC pipe and defines an interior air chamber 94, and a lower opening 96. Additionally, an upper end cap 98 is disposed to seal the upper end of the accumulator dome 92. Likewise, in the alternate embodiment, the upper end cap 98 is a common PVC end cap sized to snugly fit over the accumulator dome 92.

Extending from the upper end cap 98, is a coupling collar 100 which is sized to receive a pressure transducer 102. Extending downward from the pressure transducer 102 is an air conduit 104 disposed for communication with the interior air chamber 94. For this purpose, opening 106 is provided through the upper end cap 98. Importantly, the coupling collar 100 defines a void 108 which is filled with resin or epoxy to seal the pressure transducer 102. This construction protects the same from the harsh elements of a septic tank environment. Additionally, a containment sleeve 110, which is common PVC pipe sized to fit within the coupling collar 100. As illustrated, a snorkel tube 112, and wire harness 114 are guided through the coupling collar 100 and through the containment sleeve 110. Further, the pneumatic pressure accumulator 90 can be located within a septic tank according to the demands of a specific installation, by numerous satisfactory methods which is beyond the scope of this disclosure.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A pneumatic pump control system for controlling the on and off switching of an electrically operated pump disposed in a liquid storage tank, or septic tank provided for receiving waste liquids and solids disposed below an upper layer of air, the pneumatic pump control system comprising:

a pneumatic pressure accumulator disposed at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

a pressure transducer operatively connected to the pneumatic pressure accumulator for communication with the interior air chamber thereof to measure the differential air pressure between the air within the interior air chamber and the upper layer of air within the liquid storage tank, wherein the pressure transducer is adapted to generate an electric output signal that corresponds to the differential air pressure;

first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal dose is executed to lower the liquid level to a level at least as low as the start-level elevation; and clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air.

2. A pneumatic pump control system controlling the on and off switching of an electrically operated pump disposed in a liquid storage tank, or septic tank provided for receiving waste liquids and solids disposed below an upper layer of air, the pneumatic pump control system comprising:

a pneumatic pressure accumulator disposed at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

a pressure transducer operatively connected to the pneumatic pressure accumulator for communication with the interior air chamber thereof to measure the differential air pressure between the air within the interior air chamber and the upper layer of air within the liquid storage tank, wherein the pressure transducer is adapted to generate an electric output signal that corresponds to the differential air pressure;

first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal dose is executed to lower the liquid level to a level at least as low as the start-level elevation; and clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and wherein each dose of liquid is equal in volume.

3. A pneumatic pump control system for controlling the on and off switching of an electrically operated pump disposed in a liquid storage tank, or septic tank provided for receiving waste liquids and solids disposed below an upper layer of air, the pneumatic pump control system comprising:

a pneumatic pressure accumulator disposed at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

a pressure transducer operatively connected to the pneumatic pressure accumulator for communication with the interior air chamber thereof to measure the differential air pressure between the air within the interior air chamber and the upper layer of air within the liquid storage tank, wherein the pressure transducer is adapted to generate an electric output signal that corresponds to the differential air pressure;

first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal dose is executed to lower the liquid level to a level at least as low as the start-level elevation; and clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and wherein the pressure transducer is disposed outside the liquid storage tank and is communication with the interior air chamber by an elongated tubular member.

4. A pneumatic pump control system wherein the pressure transducer is disposed adjacent the interior air chamber of the pneumatic pressure accumulator.

5. A pneumatic pump control system for controlling the on and off switching of an electrically operated pump disposed in a liquid storage tank, or septic tank provided for receiving waste liquids and solids disposed below an upper layer of air, the pneumatic pump control system comprising:

a pneumatic pressure accumulator disposed at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

a pressure transducer operatively connected to the pneumatic pressure accumulator for communication with the interior air chamber thereof to measure the differential air pressure between the air within the interior air chamber and the upper layer of air within the liquid storage tank, wherein the pressure transducer is adapted to generate an electric output signal that corresponds to the differential air pressure;

first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal dose is executed to lower the liquid level to a level at least as low as the start-level elevation; and clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and wherein the pneumatic pressure accumulator comprises an accumulator dome defining an upper end cap, and a coupling collar that extends upward from the upper end cap to define a void for receiving the pressure transducer, wherein the pressure transducer is disposed adjacent the interior air chamber of the pneumatic pressure accumulator, within the coupling collar for communication with the interior air chamber.

6. A pneumatic pump control system controller as recited in claim 5 wherein the upper end cap of the pneumatic pressure accumulator defines an opening, and the pressure transducer comprises an air conduit disposed through the opening to allow communication between the pressure transducer and the interior air chamber.

7. A pneumatic pump control system as recited in claim 6 wherein the coupling collar further comprises resin disposed to fill the void defined by the coupling collar thereby encapsulated the pressure transducer within the resin.

8. A pneumatic pump control system as recited in claim 5 wherein the coupling collar further comprises resin disposed to fill the void defined by the coupling collar thereby encapsulated the pressure transducer within the resin.

9. A method of making a pneumatic pump control system for controlling the on and off switching of an electrically operated pump disposed in a liquid storage tank provided for receiving waste liquids and solids disposed below an upper layer of air, the method comprising the steps:

fixing a pneumatic pressure accumulator at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

connecting a pressure transducer to the pneumatic pressure accumulator for communication therebetween to measure the differential air pressure between the air within the interior air chamber and the upper layer of air within the liquid storage tank, wherein the pressure transducer is adapted to generate an electric output signal that corresponds to the differential air pressure;

providing a first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal doses is executed to lower the liquid level to a level at least as low as the start-level elevation; and providing a clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air.

10. A method of making a pneumatic pump control system for controlling the on and off switching of an electrically operated pump disposed in a liquid storage tank provided for receiving waste liquids and solids disposed below an upper layer of air, the method comprising the steps:

fixing a pneumatic pressure accumulator at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

connecting a pressure transducer to the pneumatic pressure accumulator for communication therebetween to measure the differential air pressure between the air within the interior air chamber and the upper layer of air within the liquid storage tank, wherein the pressure transducer is adapted to generate an electric output signal that corresponds to the differential air pressure;

providing a first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal doses is executed to lower the liquid level to a level at least as low as the start-level elevation; and providing a clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and wherein each dose of liquid is equal in volume.

11. A method of making pneumatic pump control system for controlling the on and off switching of an electrically operated pump disposed in a liquid storage tank provided for receiving waste liquids and solids disposed below an upper layer of air, the method comprising the steps:

fixing a pneumatic pressure accumulator at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

connecting a pressure transducer to the pneumatic pressure accumulator for communication therebetween to measure the differential air pressure between the air within the interior air chamber and the upper layer of air within the liquid storage tank, wherein the pressure transducer is adapted to generate an electric output signal that corresponds to the differential air pressure;

providing a first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal doses is executed to lower the liquid level to a level at least as low as the start-level elevation; and providing a clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and locating the pressure transducer outside the liquid storage tank and providing an elongated tubular member to facilitate communication between the pressure transducer and the interior air chamber.

12. A method of making pneumatic pump control system as recited in claim 9 further comprising the step of locating the pressure transducer adjacent the interior air chamber of the pneumatic pressure accumulator.

13. A method of making pneumatic pump control system for controlling the on and off switching of an electrically operated pump disposed in a liquid storage tank provided for receiving waste liquids and solids disposed below an upper layer of air, the method comprising the steps:

fixing a pneumatic pressure accumulator at a predetermined level within the liquid storage tank, the pneumatic pressure accumulator defining an interior air chamber for containing air, and a lower opening disposed at an elevation that represents a zero reference level, the air chamber being in communication with the liquids in the liquid storage tank when the level of the liquids are as high as the lower opening;

connecting a pressure transducer to the pneumatic pressure accumulator for communication therebetween to measure the differential air pressure between the air within the interior air chamber and the upper layer of air within the liquid storage tank, wherein the pressure transducer is adapted to generate an electric output signal that corresponds to the differential air pressure;

providing a first activation means responsive to the output signal of the pressure transducer such that when the pressure transducer indicates a pressure that corresponds to a liquid level that has risen above a predetermined start-level elevation within the liquid storage tank, the pump is activated for a period of time to discharge a predetermined quantity of liquid, referred to as a normal dose, wherein at least one normal doses is executed to lower the liquid level to a level at least as low as the start-level elevation; and providing a clearing activation means responsive to the output signal of the pressure transducer such that when the pressure transducer indicates a pressure that corresponds to a liquid level that is at least as low as the start level elevation, the pump is activated for a period of time to discharge a predetermined quantity of liquid, referred to as a clearing dose, wherein one or more clearing doses are executed to lower the liquid level to a level below the zero reference level so that the lower opening is above the liquid level, and the interior air chamber is in communication with the upper layer of air; and wherein the pneumatic pressure accumulator comprises an accumulator dome defining an upper end cap, and a coupling collar that extends upward from the upper end cap to define a void for receiving the pressure transducer, wherein the pressure transducer is disposed adjacent the interior air chamber of the pneumatic pressure accumulator within the coupling collar for communication with the interior air chamber.

14. A method of making pneumatic pump control system as recited in claim 13 wherein the upper end cap of the pneumatic pressure accumulator defines an opening, and the pressure transducer comprises an air conduit disposed through the opening to allow communication between the pressure transducer and the interior air chamber.

15. A method of making pneumatic pump control system as recited in claim 14 further comprising the step of placing resin in the coupling collar to fill the void defined by the coupling collar thereby encapsulated the pressure transducer within the resin.

16. A method of making pneumatic pump control system as recited in claim 13 further comprising the step of placing resin in the coupling collar to fill the void defined by the coupling collar thereby encapsulated the pressure transducer within the resin.

* * * * *